US006107904A

United States Patent [19]

Azzi et al.

[11] Patent Number: 6,107,904

[45] Date of Patent: Aug. 22, 2000

[54] ASYMMETRY FORMING ARRANGEMENT IN A DEFLECTION WINDING

[75] Inventors: Nacerdine Azzi, Fontaine les Dijon; Olivier Masson, Cuisery, both of France

[73] Assignee: Thomson Tubes & Displays, Boulogne, France

[21] Appl. No.: 09/292,026

[22] Filed: Apr. 16, 1999

[30] Foreign Application Priority Data

Apr. 24, 1998 [FR] France ..... 98 05183

[51] Int. Cl.[7] ..... H01F 7/00

[52] U.S. Cl. ..... 335/210; 313/440

[58] Field of Search ..... 335/210–213; 313/440–442

[56] References Cited

U.S. PATENT DOCUMENTS 4,038,621 7/1977 Chiodi et al. ..... 335/213
4,937,931 7/1990 Jacobs et al. ..... 335/213
5,302,927 4/1994 Fourche et al. ..... 335/210
5,455,483 10/1995 Azzi et al. ..... 335/210

FOREIGN PATENT DOCUMENTS 2034201 2/1969 France .
709382 5/1954 United Kingdom .

*Primary Examiner*—Lincoln Donovan
*Attorney, Agent, or Firm*—Joseph S. Tripoli; Joseph J. Laks; Sammy S. Henig

[57] ABSTRACT

A deflection yoke for a cathode-ray tube of a video display, includes a pair of horizontal deflection windings and a pair of vertical deflection windings. The pair of vertical deflection windings includes a saddle-shaped winding. The saddle-shaped winding includes a front end winding portion, close to a screen of the cathode ray tube, a rear end winding portion, remote from the screen and a pair of side winding portions, between the front and rear end portions. The saddle-shaped winding is disposed generally symmetrically with respect to a plane of symmetry. A depression or notch is formed in the front end winding portion for varying a winding distribution locally. The depression or notch forms asymmetry with respect to the plane of symmetry.

12 Claims, 5 Drawing Sheets

ASYMMETRY FORMING ARRANGEMENT IN A DEFLECTION WINDING

The invention relates to a deflection coil included in a deflection yoke for a color cathode-ray tube (CRT).

A deflection yoke may include a pair of horizontal deflection coils and a pair of vertical deflection coils, each having the form of a saddle. The particular shape of each makes it possible to minimize both the coma, geometry and convergence errors of the beams.

A CRT intended to generate color images generally comprises an electron gun which emits three coplanar electron beams, each beam being intended to excite a phosphor for a specific primary colour (red, green or blue) on the screen of the tube.

The electron beams scan the screen of the tube due to the effect of the deflection fields created by the horizontal and vertical deflection coils of the deflection yoke that is attached to the neck of the CRT. A ring or core of ferromagnetic material conventionally surrounds the saddle shaped deflection coils so as to concentrate the deflection fields in the appropriate region.

The three beams generated by the electron gun should converge on the screen of the CRT to prevent introducing a so-called convergence error which falsifies, in particular, the rendition of the colors. In order to make the three coplanar beams converge, it is known to use so-called self-converging astigmatic deflection fields; in a self-converging deflection coil, the intensity of the field or the lines of flux which are caused by the horizontal deflection winding are generally in the form of a pin-cushion in a portion of the coil which lies close to the front of the yoke on the side of the CRT which faces the display screen of the CRT. This amounts to introducing, into the winding distribution of the winding turns making up the horizontal or line coil, a highly positive 3rd harmonic of the ampere-turns density at the front of the coil.

If uniform horizontal and vertical deflection magnetic fields were used, the volume scanned by the electron beams would be a pyramid, the apex of which is coincident with the center of deflection of the deflection yoke and the intersection of which with a non-spherical screen surface exhibits a geometrical defect called pin-cushion distortion. This geometrical distortion of the image is greater when the radius of curvature of the screen of the CRT is larger. Self-converging deflection yokes generate astigmatic deflection fields making it possible to modify the North/South and East/West geometry of the image and, in particular, partially compensate for the tendency to produce North/South pin-cushion distortion.

The design of the deflection yoke must also take into account the coma, which is a distortion affecting the pair of side beams emanating from an electron gun emitting three beams in line, independently of the astigmatism of the deflection fields and of the curvature of the screen surface of the tube. These side beams enter the deflection zone at a low angle with respect to the Z axis of the tube and undergo a deflection in addition to that of the center, axial beam. Coma is generally corrected by modifying the distribution of the deflection fields at the point where the beams enter the deflection yoke so that the coma introduced compensates for that produced by the deflection field distribution necessary in order to obtain the desired astigmatism for achieving self-convergence. Thus, with regard to the horizontal deflection field, the field at the rear of the deflection yoke is in the form of a barrel and in the front part in the form of a pin-cushion.

In addition, the two, horizontal and vertical, pairs of deflection coils should generate deflection fields which are perpendicular to each other. If the two fields are not perpendicular, a phenomenon occurs in which one field is modulated with respect to the other.

The voltage amplitude developed in the horizontal deflection coil, during horizontal retrace, is about 900 volts; whereas, the voltage amplitude developed in the vertical deflection is approximately 50 volts. Therefore, the vertical deflection coils act as the secondary winding of a transformer, and the horizontal deflection coils act as the primary. This modulation effect, also called cross-modulation, is more commonly defined by the expression X Mod=100×Vv/Vh, where Vv is the voltage measured at the vertical deflection coils when the horizontal deflection coils are supplied with Vh. The cross-modulation generates geometrical problems in the image created on the screen of the tube by the scanning of the electron beams. These problems are, for example, orthogonality and parallelogram faults. The correction of these faults requires them to be taken into account when designing the deflection yoke. However, taking into account these faults may be difficult because the faults result from manufacturing problems which arise in the first phases of manufacturing the deflection yoke, when the design stage has been completed. It may be undesirably necessary to remedy these problems either by introducing a new step in the design of the deflection coils or by using electronic control circuits capable of being responsible for the geometrical corrections of the image.

In carrying out an inventive feature, the shape of the front conductor assembly of a pair of saddle-shaped coils is modified by introducing asymmetry in the conductor assembly. This modification is introduced into the manufacture by modifying the shape of the coil shaper placed in front of the mould in which the winding operation takes place. That modification has substantially no effect on the other parameters established in the design of the coil, such as the convergence or coma.

To do this, the deflection yoke for a colour cathode-ray tube according to the invention comprises a pair of horizontal deflection coils, a pair of vertical deflection coils, these coils being intended to generate magnetic deflection fields perpendicular to a main axis Z, at least one of these two pairs being in the form of a saddle and consisting of coils of conducting wires arranged so as to form a front conductor assembly and a rear conductor assembly, the two conductor assemblies being connected to each other by two lateral conductor bundles, those parts of each of said coils which form the rear conductor assembly and the lateral bundles being arranged approximately symmetrically with respect to a plane P, said deflection yoke being characterized in that it has means for locally modifying the direction of the magnetic field created by the current flow in said conductor assembly so that, considering a first zone of the front conductor assembly and a second zone symmetrical with the first zone with respect to P, the directions of the fields created in the first and second zones are not symmetrical with respect to P.

A deflection yoke, embodying an inventive feature, for a cathode-ray tube of a video display, includes a pair of horizontal deflection windings and a pair of vertical deflection windings. One of the pairs includes a saddle-shaped winding. The saddle-shaped winding includes a front end winding portion, close to a screen of the cathode-ray tube, a rear end winding portion, remote from the screen and a pair of side winding portions, between the front and rear end winding portions. The saddle-shaped winding is constructed generally symmetrically with respect to a plane defining a plane of symmetry. An arrangement is disposed in a vicinity of the front end winding portion for locally varying a deflection field produced in the front end winding portion. The deflection field varying arrangement forms field asymmetry in the vicinity of the front end winding portion with respect to the plane of symmetry.

Figure 1:
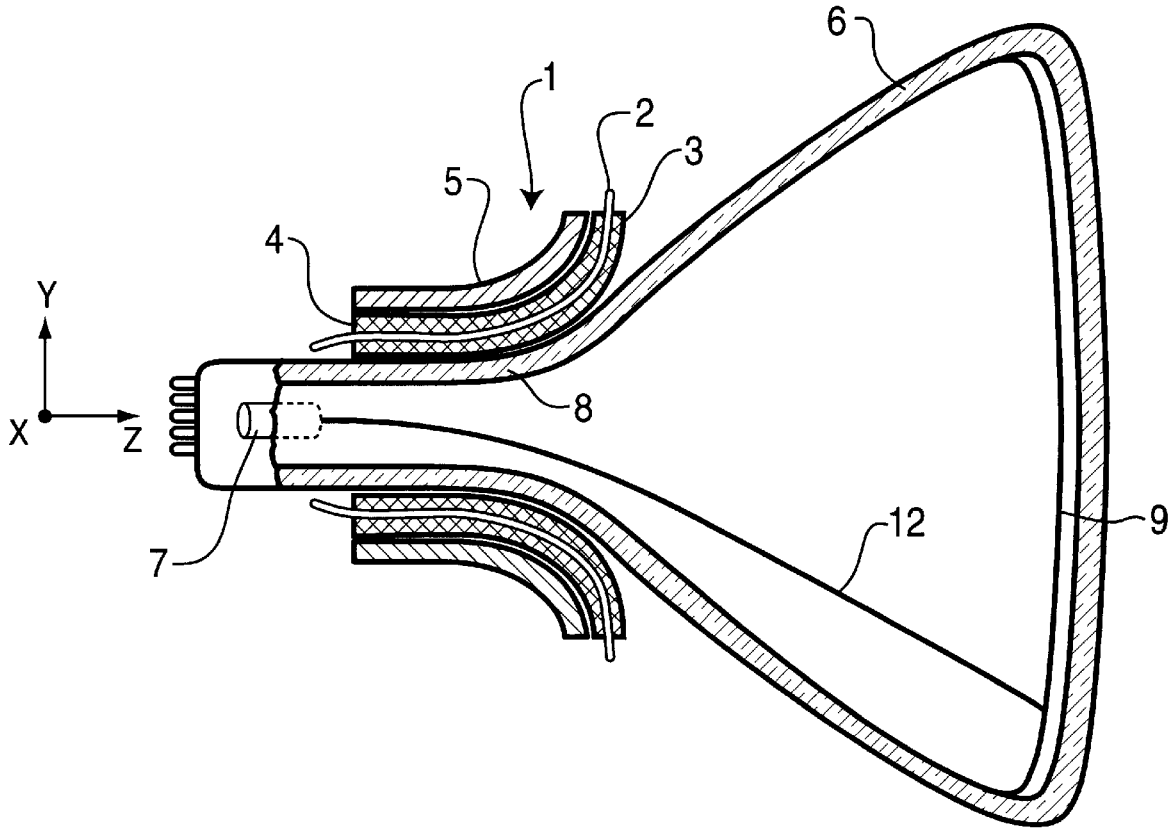
FIG. 1 shows, in cross-section, a deflection yoke, according to the invention fitted onto the neck of a cathode-ray tube.

FIG. 1 shows, in cross-section, a deflection yoke 1 that includes a feature of the invention, mounted on a neck 8 of a cathode-ray tube (CRT) 6. Deflection yoke 1 includes a pair of vertical deflection coils 4, a horizontal pair of deflection coils 3, the two pairs being insulated and separated from each other by a separator 2 generally made of plastic. A core or ring 5 of ferromagnetic material concentrates the magnetic fields created by the coils 3 and 4. These fields deflect three electron beams 12 emitted by electron gun 7 so that said beams scan the screen 9 of CRT 6.

Figure 2A:
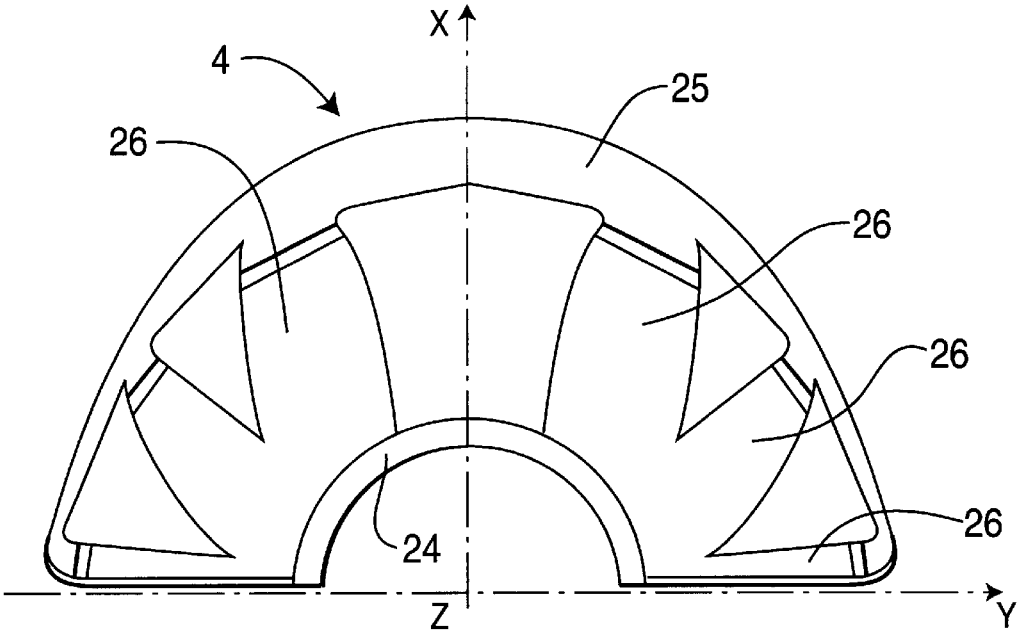
FIG. 2A PRIOR ART
FIGS. 2A and 2B show a prior art saddle-shaped coil as seen from the front and from above.
Figure 2B:
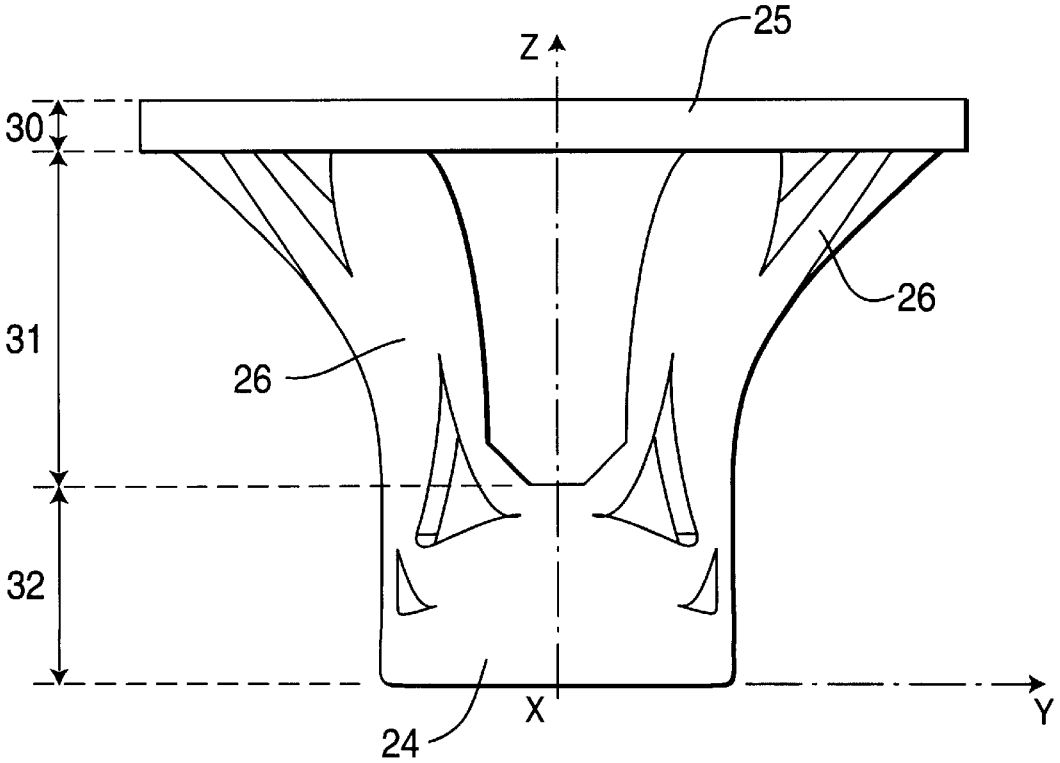
FIG. 2B PRIOR ART

FIGS. 2A and 2B illustrate saddle-shaped vertical deflection coils 4 without the inventive feature as would be in the prior art. Each coil comprises loops of conductors forming a rear end turn conductor assembly 24 lying in a rear zone 32 of FIGS. 2B and a front end turn conductor assembly 25 lying in a front zone 30. A portion of a winding turn includes a portion located in rear zone 32, a portion located in front zone 30 and a pair of side portions located in side conductor bundles 26. Conductor bundles 26 are located in a zone 31, between zones 30 and 32. A plane XZ forms a plane of symmetry of each vertical deflection coil.

During manufacture of a deflection yoke, parameters defined in the design stage may be affected by the industrial manufacturing process or by the equipment used for manufacturing said deflection yoke. For example, imperfection may cause the cross-modulation, resulting in orthogonality and parallelogram distortions.

Figure 3A:
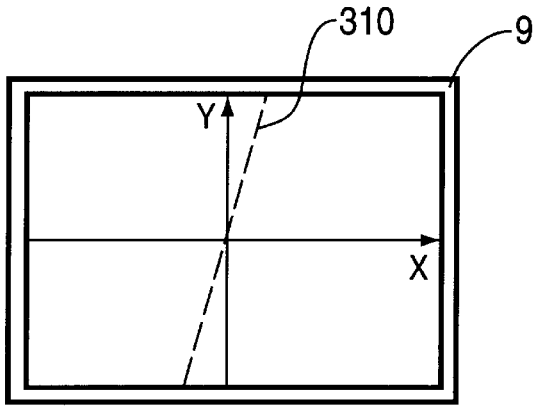
FIGS. 3A, 3B, 3C illustrate orthogonality and parallelogram defects for which the invention provides a solution.
Figure 3B:
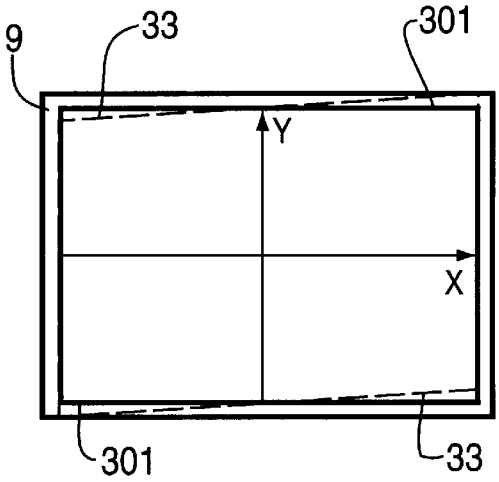
Figure 3C:
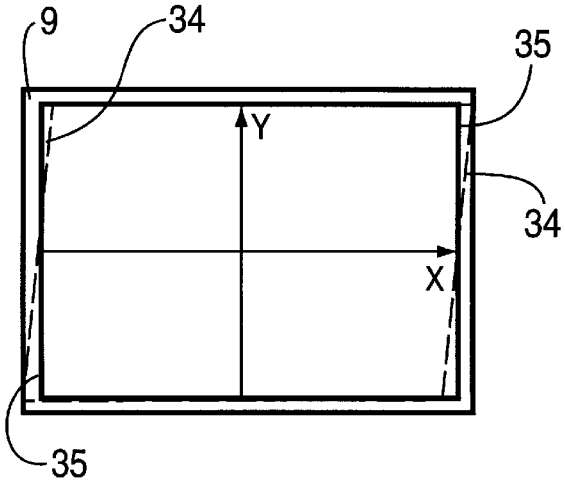

Orthogonality distortion, as shown in FIG. 3A, may cause a line 310 formed by the green central beam on screen 9 of the CRT to be slanted with respect to vertical axis Y instead of being vertical. Parallelogram distortion, as illustrated in FIGS. 3B and 3C may cause a pair of horizontal parallel lines 33 and 34 formed by the green beam to be slanted with respect to horizontal edges 301. Similarly, edges 34 are slanted with respect to vertical edges 35.

Orthogonality and parallelogram distortions required a re-design of the yoke in an undesirable, additional design step and thus arriving, by successive approximations, in obtaining a deflection yoke whose characteristics comply with specifications. It may be desirable to provide a simpler solution to these problems so that the additional re-design step of the deflection yoke would not be required and without causing a deterioration of the beam-convergence or coma parameters.

Figure 4:
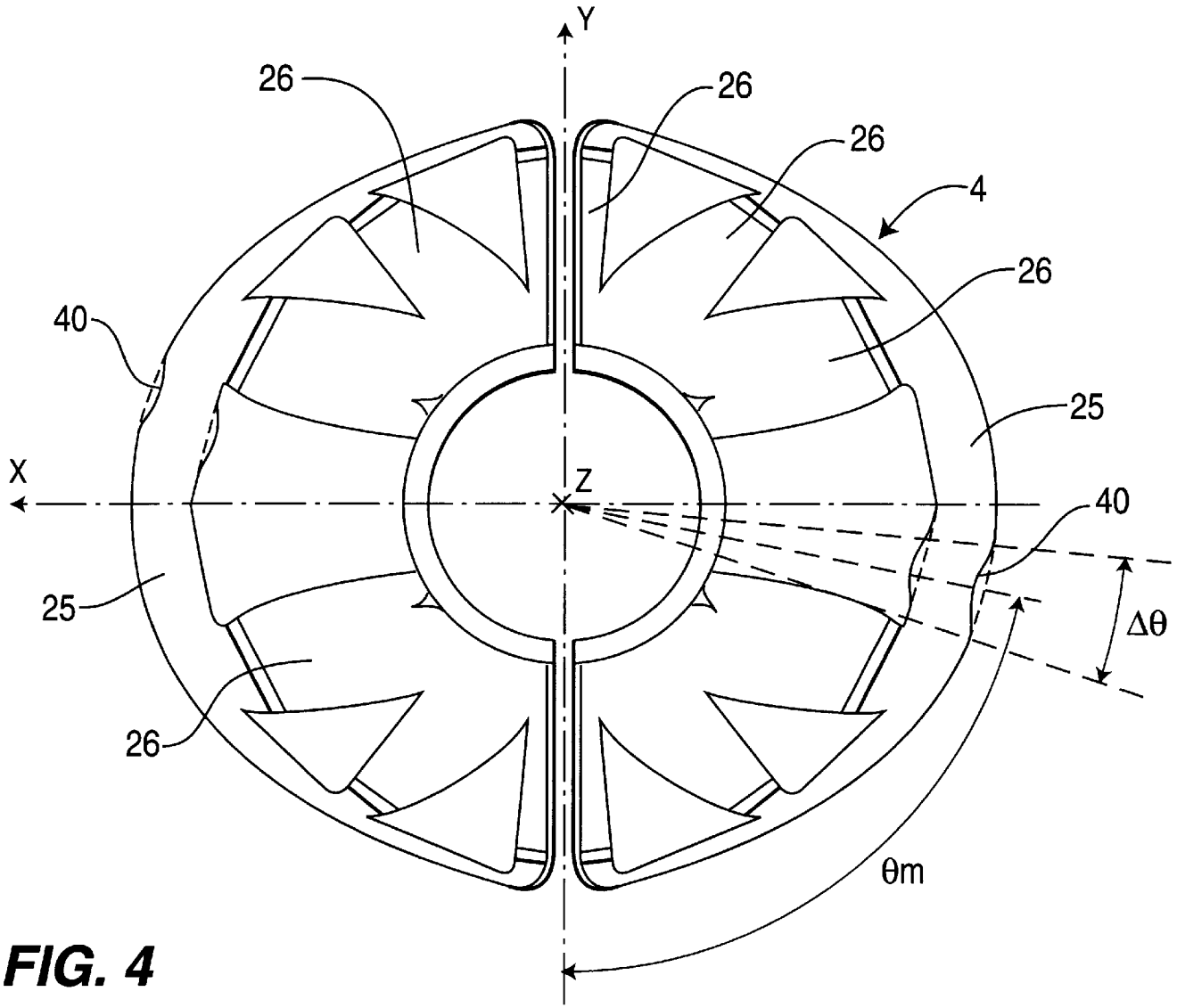
FIG. 4 illustrates a first embodiment of the invention.
Figure 5:
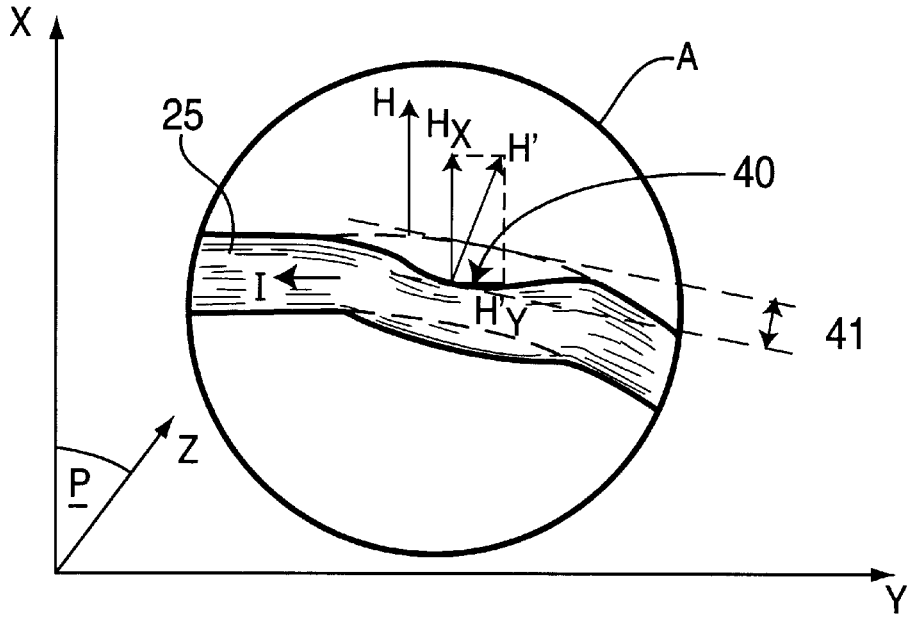
FIG. 5 shows the effect of the shape of the coil according to the invention on the field in the front of said coil.

To do this, rear conductor assembly 24 and side conductor bundles 26 of FIG. 2B are placed unmodified symmetrically with respect to a plane P of FIG. 4 defined by main axis Z of the CRT and horizontal axis X in the case of the vertical deflection coils. Whereas, the front conductor assembly 25 is modified so as to introduce a field dissymmetry producing depression or notch 40 into the conductor assembly with respect to plane P. Depression or notch 40 is shown in more details in a zone A of the conductor assembly of FIG. 4. A pair of vertical deflection coils according to the invention, as seen from the rear, are shown in FIG. 4. FIG. 5 shows a depth depression 41 created on an outside edge of the conductor assembly, and the effect of this dissymmetry on the deflection field H created by the current flow in the conductors of the front conductor assembly 25. The field H undergoes a slight rotation with respect to the direction which it would have had in the absence of the dissymmetry. The resulting field H' introduces a field component $H'_y$. This rotation, acting at the front of the deflection yoke, influences the geometry only of the image formed on the screen of the tube. The component $H'_y$ compensates for the shift or misalignment between the shifted direction of the horizontal deflection field and a desirable direction of the horizontal deflection field in order to cancel out the effects of the misalignment. The desirable direction of the horizontal deflection field is perpendicular to the vertical deflection field.

The influence of the horizontal deflection coils is dominant in the cross-modulation problem. It may be preferable to introduce the compensation effect described above into the vertical deflection coils. However, the compensation effect may be introduced into the the front conductor assembly of the saddle-shaped horizontal deflection coils in order to obtain the same effect of a local modification of the direction of the field generated by the coils.

As illustrated in FIG. 4, depression 40, located on the front conductor assembly 25 of vertical deflection coils 4, extends in a radial plane with an angular aperture $\Delta\theta$ about a mean angle $\theta_m$ measured with respect to the direction of the plane of separation YZ of the two halves vertical deflection coils. It has been discovered that the optimum effect was obtained by choosing a mean angle of between 60° and 90°, for the vertical deflection coils, and between 45° and 90°, for the horizontal deflection coils.

Depending on the required correction of the cross-modulation amplitude, a depth u41 of the depression created on the conductor assembly will vary, as will vary the angular aperture $\Delta\theta$ over which the depression extends. In addition, it may be advantageous to place several depressions or notches on the same conductor assembly in order to control their effects.

The currents in the front conductor assemblies 25 of the pair of coils are in opposite directions. Also, in the right half-screen and in the left half-screen, the forces exerted on the electron beams must be in opposite directions in order to correct the effects of the cross-modulation on the geometry of the image. Therefore, the depression(s) or notch(es) of the front conductor assembly of one of the coils and the depression(s) or notch(es) of the front conductor assembly of the other coil of the same pair of deflection coils are arranged symmetrically with respect to the Z axis.

Figure 6:
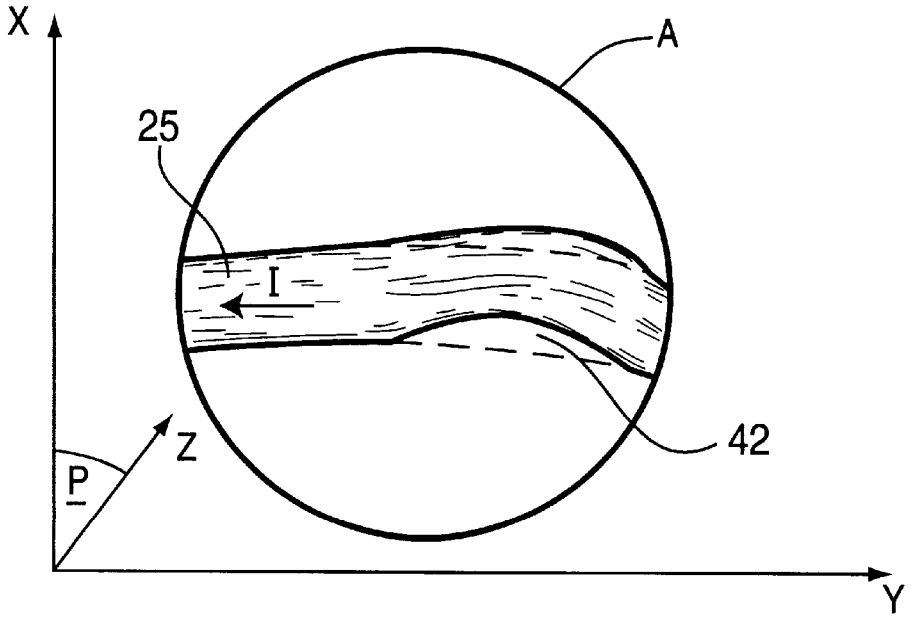
FIG. 6 illustrates a second embodiment of the invention.

The depressions or notches may be arranged on the outer part of the conductor assembly, as indicated in FIG. 5, or on the inner part of the conductor assembly, as indicated in FIG. 6. The choice depends on the local orientation which it is desired to give to the deflection field.

A major advantage of the invention is that it is easy to implement. The coil shaper is simply modified by inserting a wedge, not shown, in the front. The shape of such wedge is adjusted to match the shape of the depression to be produced on the conductor assembly of the coil. It is therefore, advantageously, no longer necessary to redefine a new mould, something which previously represented a significant additional cost.

What is claimed is:

1. A deflection yoke for a cathode-ray tube of a video display, comprising:

a pair of deflection windings, one of said pair including a saddle-shaped winding, said saddle-shaped winding including a front end winding portion, close to a screen of said cathode-ray tube, a rear end winding portion, remote from said screen and a pair of wide winding portions, between said front and rear end winding portions, said saddle-shaped winding being constructed symmetrically with respect to a plane defining a plane of symmetry thereof; and means disposed in a vicinity of said front end winding portion for locally varying a deflection field produced in said front end winding portion, said deflection field varying means forming field asymmetry in the vicinity of said front end winding portion with respect to said plane of symmetry.

2. A deflection yoke according to claim 1 wherein said field varying means comprises a depression for varying a winding distribution to form said asymmetry.

3. A deflection yoke for a cathode-ray tube of a video display, comprising:

a pair of deflection windings for producing a deflection field, one of said pair including a saddle-shaped winding having a front end winding portion; close to a screen of said cathode-ray tube, a rear end winding portion, remote from said screen and a pair of side winding portions, between said front and rear end winding portions; and means disposed in a vicinity of said front end winding portion for locally varying a field produced in said front end winding portion to locally vary a direction of one of a horizontal and deflection field and a vertical deflection field with respect to a direction of the other one of said horizontal and vertical deflection fields and provide for deflection field alignment.

4. A deflection yoke according to claim 3 wherein said field varying means comprises a depression for varying a winding distribution.

5. A deflection yoke according to claim 4 wherein said depression is formed on one of an outer edge and an inner edge of said front end winding portion.

6. A deflection yoke according to claim 5, wherein said saddle shaped winding provides vertical deflection.

7. A deflection yoke according to claim 4 wherein the depression extends, in a plane perpendicular to a longitudinal axis of said cathode ray tube, in a radial direction between 60° and 90°.

8. A deflection yoke according to claim 4, wherein said one of said pairs includes a second saddle-shaped winding having a front end winding portion, close to a screen of said cathode-ray tube, a rear end winding portion, remote from said screen and a pair of side winding portions, between said front and rear end winding portions, wherein a second depression is formed in said front end winding portion of said second saddle-shaped winding and wherein both depressions are disposed symmetrically with respect to a longitudinal axis of said cathode ray tube.

9. A deflection yoke for a cathode-ray tube of a video display, comprising:

a pair of deflection windings, one of said pair including a saddle-shaped winding, said saddle-shaped winding including a front end winding portion, close to a screen of said cathode-ray tube, a rear end winding portion, remote from said screen and a pair of side winding portions, between said front and rear end winding portions, said saddle-shaped winding being constructed symmetrically with respect to a plane defining a plane of symmetry thereof; and a depression for locally varying a winding distribution in said front end winding portion, said depression forming asymmetry in said front end winding portion with respect to said plane of symmetry.

10. A deflection yoke for a cathode-ray tube of a video display, comprising:

a pair of deflection windings for producing a deflection field, one of said pair including a saddle-shaped winding having a front end winding portion, close to a screen of said cathode-ray tube, a rear end winding portion, remote from said screen and a pair of side winding portions, between said front and rear end winding portions; and a depression formed in said front end winding portion for locally varying a winding distribution therein to vary a direction of one of a horizontal deflection field and a vertical deflection field with respect to a direction of the other one of said horizontal and vertical deflection fields to provide for deflection field alignment.

11. A deflection yoke according to claim 1 wherein said pair of deflection windings provides vertical deflection.

12. A deflection yoke according to claim 9 wherein said pair of deflection windings provides vertical deflection.

* * * * *